US012690699B2

(12) United States Patent
Schwarz et al.

(10) Patent No.: US 12,690,699 B2
(45) Date of Patent: Jul. 28, 2026

(54) SPACER FOR A SHELF SUPPORT, COMPRISING A LIGHT EMITTER

(71) Applicant: VusionGroup Deutschland GmbH, Ettenheim (DE)

(72) Inventors: Thomas Schwarz, Hohberg (DE); Michael Unmüßig, Ettenheim (DE)

(73) Assignee: VusionGroup Deutschland GmbH, Ettenheim (DE)

( * ) Notice: Subject to any disclaimer, the term of this patent is extended or adjusted under 35 U.S.C. 154(b) by 67 days.

(21) Appl. No.: 18/289,663

(22) PCT Filed: May 6, 2022

(86) PCT No.: PCT/EP2022/062254
§ 371 (c)(1),
(2) Date: Nov. 6, 2023

(87) PCT Pub. No.: WO2022/234068
PCT Pub. Date: Nov. 10, 2022

(65) Prior Publication Data

US 2024/0245236 A1 Jul. 25, 2024

(30) Foreign Application Priority Data

May 7, 2021 (FR) ..... 2104850

(51) Int. Cl.
*A47F 11/06* (2006.01)
*A47F 5/10* (2006.01)
(Continued)

(52) U.S. Cl.
CPC ..... *A47F 11/06* (2013.01); *A47F 5/105* (2013.01)

(58) Field of Classification Search
CPC ..... A47F 11/06
See application file for complete search history.

(56) References Cited

U.S. PATENT DOCUMENTS 6,366,196 B1 * 4/2002 Green ..... G08B 5/229 340/10.6
2007/0013479 A1 * 1/2007 Goel ..... G09F 3/208 340/815.45

(Continued)

FOREIGN PATENT DOCUMENTS

CN 109598164 A 4/2019
CN 211432009 U 9/2020

(Continued)

OTHER PUBLICATIONS

International Search Report for PCT/EP2022/062254 mailed Aug. 31, 2022. 4 pages.

(Continued)

*Primary Examiner* — Davetta W Goins
*Assistant Examiner* — Pameshanand Mahase
(74) *Attorney, Agent, or Firm* — Lerner David LLP

(57) ABSTRACT

The invention relates to a spacer (10) adapted to be fixed on a shelf support (100) so as to delimit a column of the shelf support (100), wherein the spacer (10) comprises a light-emitter (20) integrated in the spacer (10) and configured to emit light, wherein the light emitted by said light emitter (20) forms a signal corresponding to a blinking sequence which is specific to said light emitter (20) and allows identification of the spacer (10) in which the light emitter (20) is integrated.

15 Claims, 6 Drawing Sheets

(51) Int. Cl.

| | |
|---|---|
| ***G06Q 10/08*** | (2024.01) |
| ***G06Q 10/087*** | (2023.01) |
| ***G06V 10/141*** | (2022.01) |
| ***H04W 4/35*** | (2018.01) |

(56) References Cited

U.S. PATENT DOCUMENTS

| | | | | |
|---|---|---|---|---|
| 2009/0166415 | A1* | 7/2009 | Braun | G06Q 10/087 235/385 |
| 2011/0055103 | A1* | 3/2011 | Swafford, Jr. | G06Q 10/087 705/345 |
| 2016/0364634 | A1 | 12/2016 | Davis et al. | |
| 2017/0103515 | A1 | 4/2017 | Hulth | |
| 2017/0293959 | A1 | 10/2017 | Itou et al. | |
| 2018/0165626 | A1* | 6/2018 | Davidson | G06Q 10/08 |
| 2018/0286002 | A1* | 10/2018 | Peck | B65G 1/1371 |
| 2020/0234227 | A1 | 7/2020 | Gadou et al. | |
| 2022/0272235 | A1* | 8/2022 | Gordon | G06T 19/006 |
| 2022/0360695 | A1 | 11/2022 | Schwarz et al. | |

FOREIGN PATENT DOCUMENTS

| | | | |
|---|---|---|---|
| EP | 3032459 | A1 | 6/2016 |
| FR | 3071341 | A1 | 3/2019 |
| FR | 3072492 | A1 | 4/2019 |
| FR | 3099020 | A1 | 1/2021 |
| JP | H0269605 | U | 5/1990 |
| JP | 2005212962 | A | 8/2005 |
| WO | 2018102575 | A1 | 6/2018 |
| WO | 2019073063 | A1 | 4/2019 |

OTHER PUBLICATIONS

French Preliminary Search Report for Application No. FR 2104850 dated Nov. 30, 2021, 3 pages.

* cited by examiner

SPACER FOR A SHELF SUPPORT, COMPRISING A LIGHT EMITTER

CROSS-REFERENCE TO RELATED APPLICATIONS

The present application is a national phase entry under 35 U.S.C § 371 of International Application No. PCT/EP2022/062254 filed May 6, 2022, which claims priority from French Application No. 2104850 filed May 7, 2021, all of which are hereby incorporated herein by reference.

The present invention relates to a spacer for managing stock of a shelf support, and to a method spacer identification. The shelf support is intended to receive merchandise and to be installed in a salespoint.

GENERAL TECHNICAL FIELD AND PRIOR ART

Merchandise is generally displayed in salespoints. Merchandise consists in articles of various natures, for example food or other goods, which can be bought by a customer in the salespoint. The salespoint comprises several aisles. Shelves, such as gondolas, are generally located at least on one side of an aisle, so that a customer walking in the aisle may easily see the merchandise displayed on the shelves.

As illustrated in FIG. 1, a shelf 1 generally comprises several shelf supports 100 which are vertically spaced apart from each other. Articles 200 to be displayed are placed on the shelf supports 100. Articles 200 of a given nature may be placed on the shelf supports 100 one behind the other so as to form a line of articles 200. A shelf support 100 comprises several adjacent lines of articles 200, each line corresponding to a given nature of article 200.

Adjacent columns of a shelf support can be delimited by spacers. The spacers extend generally along the whole length of the column, in order to physically separate the adjacent columns and help securing and positioning the articles inside each column. Thus, the articles may be positioned inside each column with accuracy and reliability, and in an orderly fashion. Several lines of articles can be accommodated abreast inside one column formed between two adjacent spacers.

Shelf labels are usually positioned on a front panel of the shelf support located under or next to the columns delimited by the spacer, so as to be directly visible by a customer walking in an aisle in which the shelf is positioned. The shelf labels display information relative to the articles positioned in the nearby line(s), such as price, price per weight, name of the article, etc.

A particularly important issue for salespoints is the management of stock. Stock shortage leads to financial losses, as the out-of-stock article is not purchased by the client. Stock shortage should be anticipated so that fast replenishment can be accomplished if needed.

Electronic shelf labels (referred to below as "ESL") are a type of shelf labels which is commonly used in order to help manage stocks, in particular in order to regularly update a database of the stocks of the articles placed on the shelf supports of the salespoint, thus reducing the risk of stock shortage.

An ESL comprises a screen which allows automatic updates of the article information displayed on the screen, such as price updates. An ESL also classically comprises a light emitter configured to emit light according to a blinking sequence which is specific to the ESL, upon reception of a blinking order.

The salespoint comprises one or several base station(s). The base station(s) of the salespoint communicate(s) with the ESLs of the salespoint via far field radio communication, for example via a low power radio communication module of the base station. The base station(s) may thus occasionally transmit update orders to the ESLs so as to automatically update the ESLs information. The base station(s) may also occasionally transmit blinking orders to all ESLs, so as to trigger performing of their specific blinking sequences by the light emitters of all the ESLs of the salespoint.

Cameras may be installed in the salespoint in order to film the shelves and the ESLs positioned on the shelves. More specifically, a camera may be placed facing a shelf, on the other side of the aisle relative to the shelf, so as to film the shelf. The camera may thus detect a near-empty or an empty space on a shelf support of the shelf, which correspond to a stock shortage area. The camera also acquires the blinking sequences performed by the light emitters of the ESLs positioned on the filmed shelf.

The nature of the out-of-stock article can thus be determined by identifying the ESL which is closest to the detected stock shortage area, the identification being performed based on the acquired blinking sequence which is specific to said ESL. An alert can then be generated, indicating to replenish the stock of the determined article.

However, this system for managing stock shortages only functions when ESLs are implemented. As a matter of fact, ESLs are not implemented in all salespoints, regions or countries, or even in all areas of a given salespoint. ESLs may for example be implemented only in areas of the store displaying products for which the stock management is most critical. When ESLs are not present, it is necessary to foresee another way to anticipate stock shortages.

Furthermore, ESLs necessitate a dedicated infrastructure and a specific installation to be implemented.

In addition, the positioning of the ESLs relative to the articles it refers to is not standardized and may vary from article to article. The ESL may be placed on the shelf support under the corresponding article, but may also be deported to the right or to the left of the article. Thus, when the camera detects a stock shortage, errors can be made in identifying the ESL corresponding to the out-of-stock article, resulting in an incorrect identification of the out-of-stock article. This leads to a lack of effectiveness in the management of stock.

Finally, it is important that the camera acquiring images of a shelf does not move, and is precisely positioned facing said shelf. Otherwise, the camera may not accurately detect a near-empty or empty space on the shelf support, and/or may not correctly identify the ESLs. The precise and reliable positioning and fixing of the camera is difficult to achieve. The camera may be fixed to a ceiling or to a wall of the salespoint, but then the camera may not accurately acquire images some of the shelf supports, especially the higher shelf supports. The camera may be fixed to a shelf, but then the camera takes up space on the shelf and is visible for the customer of the salespoint.

GENERAL PRESENTATION OF THE INVENTION

An aim of the invention is to provide a spacer which reduces the costs of the management of stock of a shelf support.

Another aim of the invention is to provide a system for managing stock of a shelf support which does not require the presence of ESLs.

According to a first aspect, the invention is directed towards a spacer adapted to be fixed on a shelf support so as to delimit a column of the shelf support, wherein the spacer comprises a light-emitter integrated in the spacer and configured to emit light, wherein the light emitted by said light emitter forms a signal corresponding to a blinking sequence which is specific to said light emitter and allows identification of the spacer in which the light emitter is integrated.

Some preferred but not limitative features of the spacer described above are the following, taken individually or in combination:

- the spacer comprises a partition wall adapted to delimit two adjacent columns of the shelf support, the partition wall comprising two opposite side panels, wherein the spacer further comprises a front panel adapted to connect the two opposite side panels of the partition wall;
- the spacer comprises a plate adapted to be stacked on the shelf support so as to delimit the column of the shelf support;
- the light emitter is integrated in the front panel of the spacer;
- the light emitter is a LED;
- the light emitter is configured to emit a visible light;
- the light emitter is configured to emit a green light;
- the light emitter is configured to emit an infrared light;
- the spacer further comprises a battery adapted to supply power to the light emitter;
- the spacer further comprises a communication module adapted to trigger the blinking sequence of a light emitter according to an order from a base station;
- the communication module may be adapted to communicate with the base station via far field radio communication;
- the communication module may be adapted to communicate with another spacer via near field radio communication;
- the spacer further comprises a person sensor adapted to detect an object or a person obstructing the light emitter of the spacer, wherein the communication module is adapted to trigger a blinking sequence of the light emitter according to an output of the person sensor;
- the spacer further comprises a camera integrated in the spacer, said spacer being a monitoring spacer;
- the camera comprises a motorized lens allowing to change a viewing direction of the camera;
- the monitoring spacer may be adapted to be mounted on a shelf support which is located opposite the spacer comprising the light emitter whose blinking sequence should be acquired by the camera relative to an aisle of the salespoint;
- the spacer further comprises an LCD screen integrated in the spacer;
- the spacer forms an integral casing adapted to integrate components of the spacer;
- the spacer comprises a front casing adapted to integrate components of the spacer, and a window adapted to be mounted on the front casing, the front casing and the window delimiting together two adjacent columns of the shelf support.

According to a second aspect, the invention is directed towards a set of spacers comprising a plurality of spacers a spacer according to the first aspect, wherein each spacer of the set of spacers comprises a light emitter having a unique specific blinking sequence different from the blinking sequences of the light emitters of the other spacers of the set of spacers, so that for each spacer of the set of spacers, the blinking sequence of the light emitter of said spacer allows identification of said spacer.

According to a third aspect, the invention is directed towards a system comprising a spacer according to the first aspect and an identification unit, wherein the identification unit is adapted to receive a blinking sequence emitted by the light emitter of the spacer, wherein the identification unit is further adapted to identify the spacer corresponding to the acquired blinking sequence.

Said identification may be performed based on a correspondence table comprising a plurality of blinking sequences, wherein each blinking sequence is associated to a respective spacer in said correspondence table.

According to a fourth aspect, the invention is directed towards a shelf system comprising a shelf support, a spacer according to the first aspect, the spacer being fixed to the shelf support, and a camera configured to visually acquire the blinking sequence performed by the light emitter of the spacer.

The camera may be integrated in a monitoring spacer according to the first aspect, wherein the monitoring spacer is adapted to be fixed to a shelf support so that the light emitter of the spacer is visible by the camera of the monitoring spacer.

The shelf system may further comprise an identification unit adapted to receive a blinking sequence acquired by the camera, wherein the identification unit is further adapted to identify the spacer corresponding to the acquired blinking sequence.

Said identification may be performed based on a correspondence table comprising a plurality of blinking sequences, wherein each blinking sequence is associated to a respective spacer in said correspondence table.

According to a fifth aspect, the invention is directed towards a method for spacer identification adapted to be performed by a shelf system according to the fourth aspect, comprising the following steps:

- S1: triggering a blinking sequence of the light emitter integrated in the spacer by the communication module;
- S2: performing the blinking sequence by the light emitter;
- S3: visually acquiring the blinking sequence by the camera.

The method may further comprise the following steps:

- S4: receiving, by the identification unit, the blinking sequence acquired by the camera; and
- S5: identifying, by the identification unit, the spacer corresponding to the acquired blinking sequence. Said identification may be performed based on a correspondence table comprising a plurality of blinking sequences, wherein each blinking sequence is associated to a respective spacer in said correspondence table.

The method may further comprise a step of detecting, by a person sensor, an object or a person obstructing the light emitter of the spacer, wherein the communication module is adapted to trigger the blinking sequence of the light emitter in step S1 according to an output of the person sensor.

PRESENTATION OF THE FIGURES

Other features and advantages of the invention will emerge from the following description, which is purely illustrative and non-limiting and must be considered with respect to the appended figures in which:

FIG. 1, which was previously discussed, is a perspective view of a shelf according to the prior art;

DESCRIPTION OF DETAILED EMBODIMENTS

Figure 3:
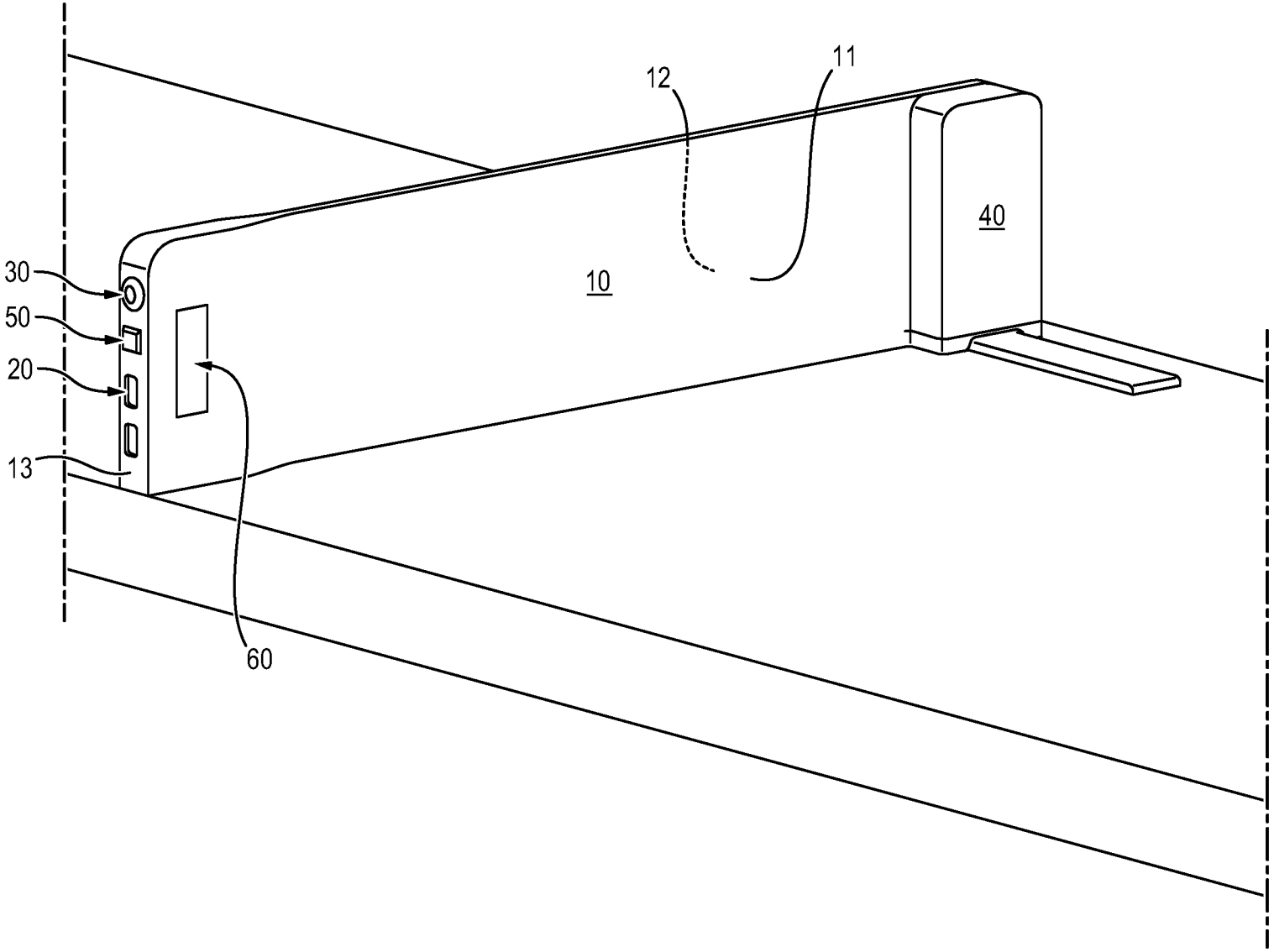
FIG. 3 is a perspective view of a spacer according to an embodiment of the invention, the spacer being fixed on a shelf support.
Figure 5:
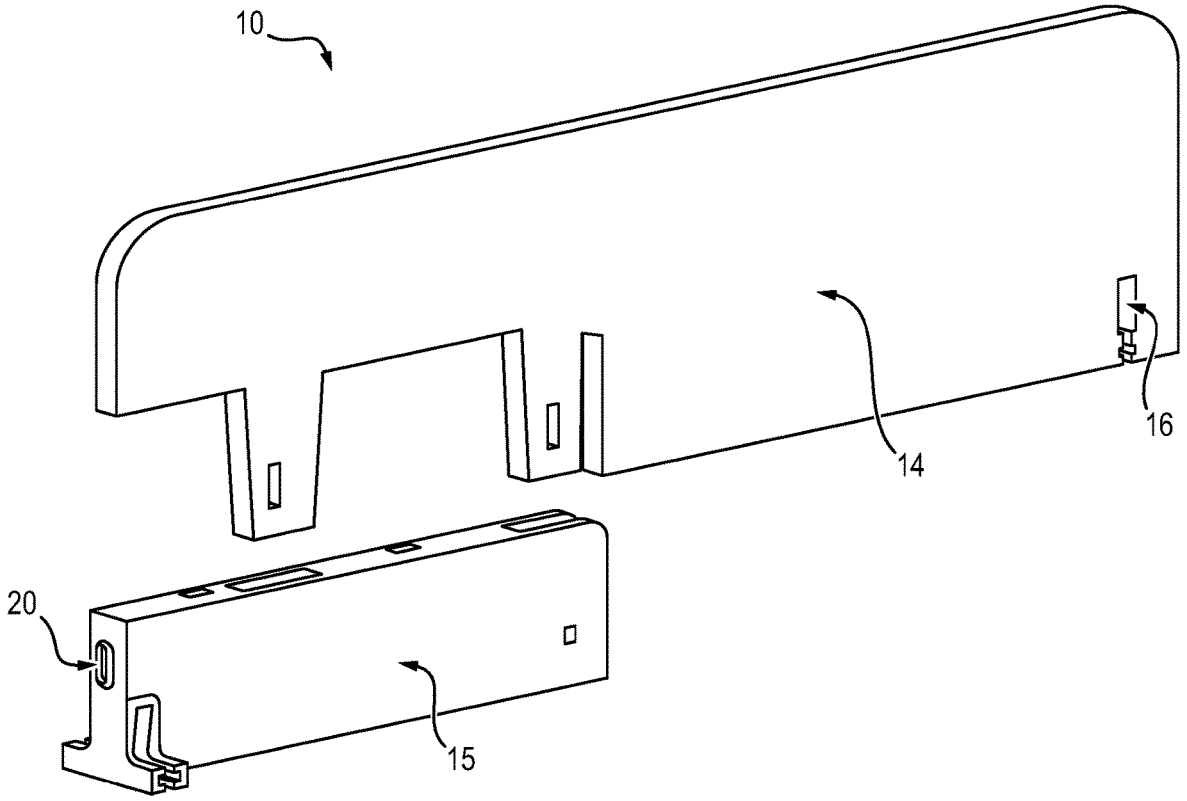
FIG. 5 is a perspective exploded view of a spacer according to another embodiment of the invention.
Figure 6:
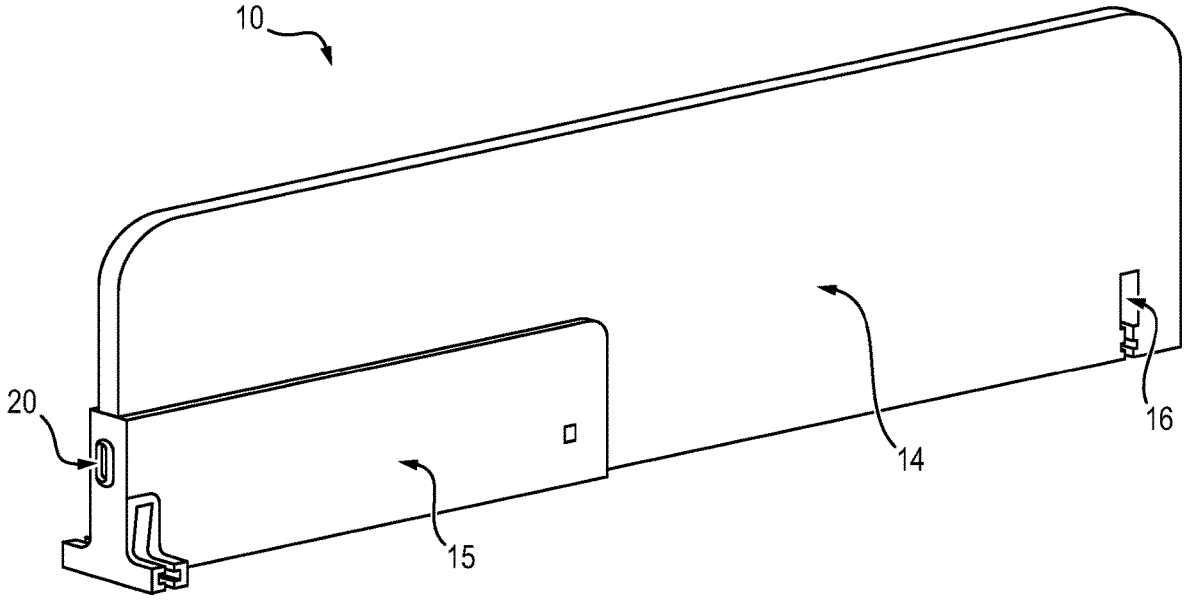
FIG. 6 is a perspective assembled view of the spacer of FIG. 5.

A spacer 10 adapted to be fixed on a shelf support 100 so as to delimit a column of the shelf support 100 is illustrated by way of a non-limiting example in FIGS. 3, 5 and 6.

The spacer 10 comprises a light-emitter integrated in the spacer 10 and configured to emit light, wherein the light emitted by said light emitter 20 forms a signal corresponding to a blinking sequence which is specific to said light emitter 20 and allows identification of the spacer 10 in which the light emitter 20 is integrated.

The positioning of such a spacer 10 is precise and reliable. A spacer 10 delimits a column of the shelf support 100, that is to say delimits an area of the shelf support 100 where articles 200 are to be displayed.

As the spacer 10 is fixed to the shelf support 100, a position of the spacer 10 relative to said shelf support 100 is known. A position of the spacer 10 in the salespoint may also be known. A nature and a position of the articles 200 displayed in a column delimited by the spacer 10 relative to said spacer 10 is also known, said articles 200 being associated with the spacer 10. Thus, the spacer 10 defines nature(s) and position(s) of the articles 200 located in the column delimited by the spacer 10. As the spacer 10 can be identified based on the blinking sequence of the light emitter 20, the nature(s) and the position(s) of the corresponding articles 200 displayed in the column delimited by the spacer 10 can also be correctly identified. A nature of an article 200 may correspond to a type of article 200 and/or to a brand of article 200, for example a specific cream, cereals, vegetable, etc.

Furthermore, the spacer 10 is easily installed on the shelf support 100, like a conventional spacer 10, and requires no dedicated infrastructure to be operational. More particularly, the spacers 10 do not require the presence of ESLs to be operational. The dimensions of the spacer 10 substantially correspond to the dimensions of a conventional spacer 10, which allows to save space.

The light emitted by the light emitter 20 of the spacer 10 forms a signal corresponding to a blinking sequence. In other words, the light emitter 20 is adapted to flash to emit several light pulses, thereby performing a blinking sequence. The several light pulses have different durations and are spaced from each other by variable time intervals. The durations of and time intervals between the signal formed by the sequence of light pulses is specific to the light emitter 20, that is to say characterizes the light emitter 20. Thus, the blinking sequence of the light emitter 20 is distinctive of the light emitter 20 and allows identification of the spacer 10 in which the light emitter 20 is integrated.

The performing of a blinking sequence of light pulses by the light emitter 20 may be triggered by a blinking order transmitted to the light emitter 20.

Figure 1:
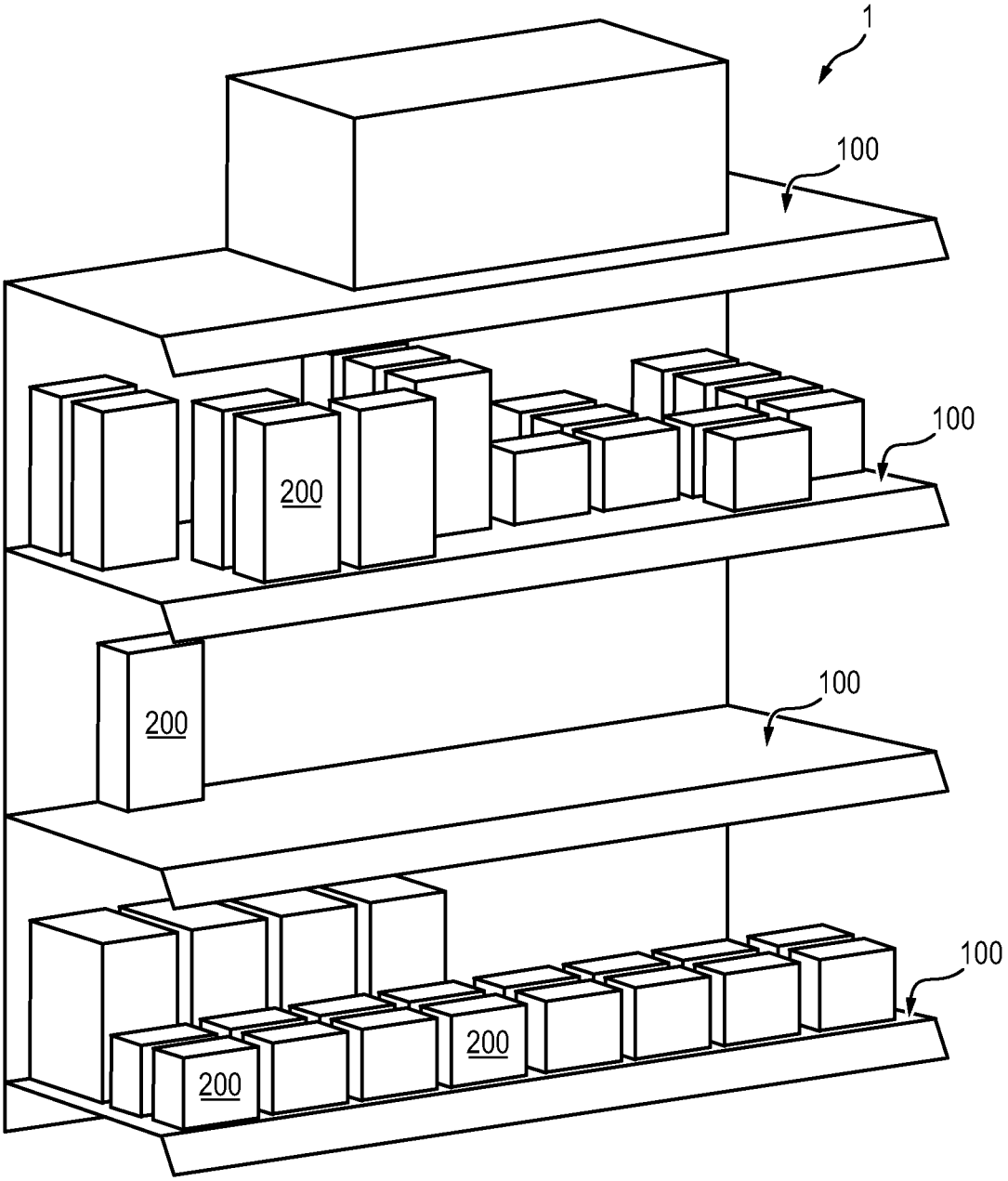
Figure 2:
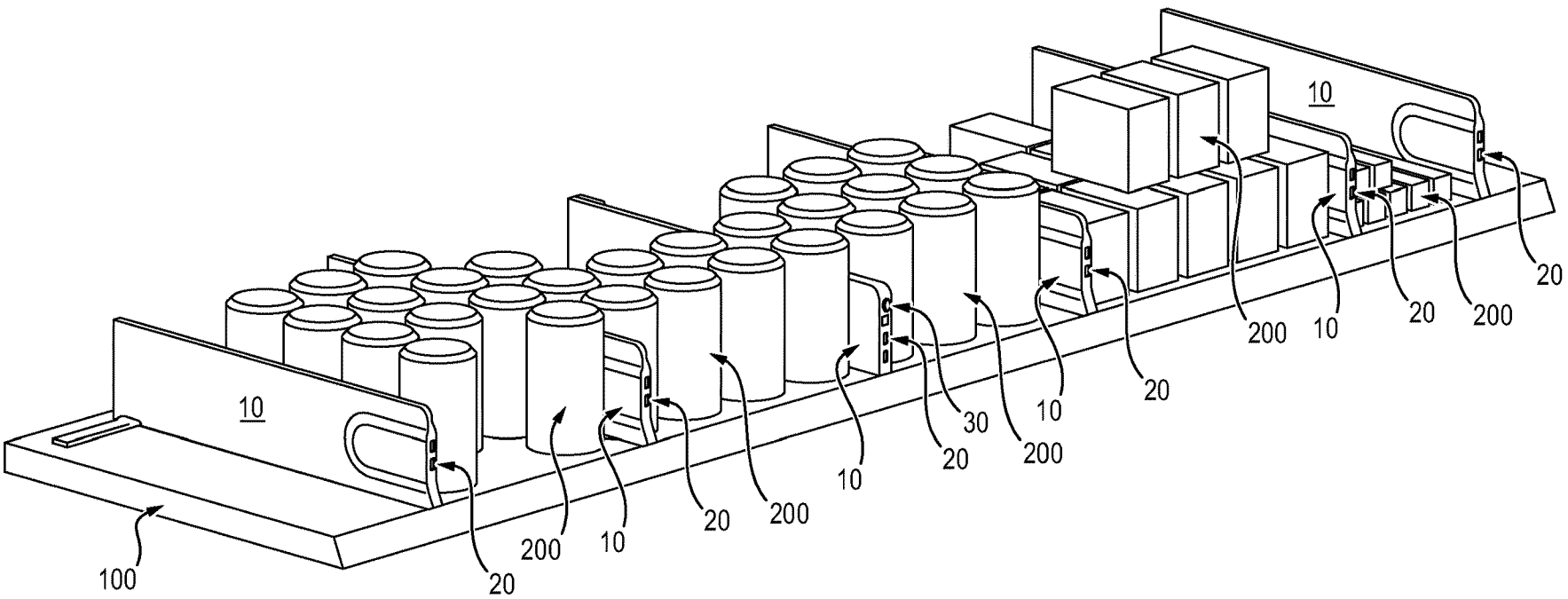
FIG. 2 is a perspective view of a shelf support comprising a spacer according to an embodiment of the invention.

A shelf support 100, as illustrated by way of a non-limiting example in FIG. 2, may be a substantially planar shelf support 100 extending in a shelf support plane. The shelf support plane is defined by a lateral direction and by a longitudinal direction, the longitudinal direction being perpendicular to the lateral direction. A vertical direction corresponds to a direction perpendicular to shelf support plane. A length corresponds to a dimension along the longitudinal direction. A width corresponds to a dimension along the lateral direction. A height corresponds to a dimension along the vertical direction.

A salespoint may comprise several aisles forming passages for customers of the salespoint. A shelf 1 may be located in an aisle of the salespoint. The shelf 1 may comprise one shelf support 100, or several shelf supports 100 which are vertically spaced apart from each other. A shelf support 100 is adapted to accommodate shelf labels, which can be ESLs. The salespoint may comprise a base station comprising a far field communication module.

Articles 200 to be displayed are placed on the shelf supports 100. Articles 200 of a given nature may be placed on the shelf support 100 one behind the other in the longitudinal direction so as to form a line of articles 200. A shelf support 100 comprises several adjacent lines of articles 200, each line of articles 200 corresponding to a given nature of article 200 which may be the same or different from a nature of articles 200 of an adjacent line of articles 200.

More specifically, shelves 1 may be located on each side of an aisle, the shelves 1 being opposite to each other relative to the aisle, so that the shelves 1 face each other and are located on both sides of a customer walking in the aisle. The customer walking in the aisle may thus chose articles 200 displayed on the shelves 1, on either side of the customer.

One or more spacers 10 are fixed on the shelf support 100 so as to delimit columns of the shelf support 100. A column width, that is to say a column dimension in the lateral direction, may correspond substantially to a dimension of the article 200 to be placed in the column. Thus, the article's 200 position in the column is even more precisely known. Alternatively, the column width may be greater than a dimension of the article 200 to be placed in the column, so that the column delimited by the spacer 10 is adapted to accommodate several lines of articles 200, a line of articles 200 being formed by a succession of articles 200 placed one behind the other in the longitudinal direction. One or several line(s) of articles 200 of one or several given nature(s) can thus be arranged abreast in a given column delimited by the spacer 10. The nature of the articles 200 displayed in the line(s) of articles 200 located in the given column delimited by the spacer 10 is known and their position relative to the spacer 10 is known.

According to a first example, the spacer 10 fixed on the shelf support 100 comprises a plate adapted to be stacked on the shelf support so as to delimit the column of the shelf support 100.

The spacer plate 10 may be a rectangular plate adapted to extend mainly in the longitudinal and the lateral direction, that is to say in a plane substantially parallel to the shelf support plane. A dimension of the spacer plate 10 in the lateral direction corresponds to the column width. Two adjacent spacer plates 10 may be arranged side by side and in contact with each other so as to delimit two adjacent columns of the shelf support 100.

The spacer plate 10 may present a height in the vertical direction which is sufficient to integrate components of the spacer plate 10, the spacer plate 10 forming a substantially rectangular block. The spacer plate 10 thus forms a stable casing, for fresh and normal environments, the casing being furthermore adapted to integrate components of the spacer plate 10.

The spacer plate 10 is stacked on the shelf support 100. The spacer plate 10 may be adapted to extend along the whole length of the shelf support 100. Articles 200 of a given column delimited by the spacer plate 10 are displayed on the spacer plate 10 in one or several line(s) of articles 200 arranged abreast on the spacer plate 10. Two adjacent lines of articles 200 displayed on the spacer plate 10 may contain articles 200 of a same nature or of different natures. The articles 200 displayed on the spacer plate 10 correspond to the articles 200 associated with the spacer plate 10. The nature and/or position of the articles 200 associated with the spacer plate 10 relative to the spacer plate 10 is thus known.

Components integrated in the spacer plate 10 include a light emitter 20. Components integrated in the spacer plate 10 may further include one or several of the following components: a camera 30, a person sensor 50, an identification unit, a communication module, and/or a battery 40.

According to a particular example, one spacer plate 10 may display articles 200 of one or several different natures. Articles 200 of a given nature are displayed on the spacer plate 10 in one or several adjacent line(s) of articles 200 arranged abreast. Components integrated in the spacer plate 10 may include several light emitters 20 regularly spaced apart from each other along the width of the spacer plate 10. One or several adjacent light emitter(s) 20 is/are associated with one given nature of articles 200, for example so that a total distance between the light emitters 20 associated with one given nature of articles 200 correspond to a width of said one or several adjacent line(s) of articles 200 of the given nature. The nature and/or position of the articles 200 associated with said one or several adjacent light emitter(s) 20 of the spacer plate 10 relative to the spacer plate 10 is known. For example, if the spacer plate 10 has a width of 50 cm integrating 10 light emitters 20 spaced every 5 cm of the spacer plate 10, and if articles 200 of a given nature are intended to be displayed on several lines of articles 200 having a total width of 20 cm, then the 4 adjacent light emitters 20 located below the articles of said given nature to be displayed may be associated with the articles 200 of said given nature.

The light emitter 20, camera 30, person sensor 50, identification unit, communication module, and/or battery 40, may be integrated in a front panel 13 of the spacer plate 10. The front panel 13 of the spacer plate 10 extends substantially in the lateral and the vertical direction so as to define the height of the rectangular block of the spacer plate 10, and is visible by a person or an imaging device facing the shelf 1 where the spacer plate 10 is installed. Therefore, the light emitter 20 integrated in the front panel 13 is visible by a camera 30 facing the shelf 1.

According to a second example, illustrated by way of example in FIGS. 3, 5 and 6, the spacer 10 fixed on the shelf support 100 is adapted to extend mainly in the longitudinal and in the vertical direction of the shelf support 100, substantially perpendicularly to the shelf support plane. The spacer 10 may be adapted to extend along the whole length of the shelf support 100. The spacer 10 presents a height which is sufficient to delimit the two adjacent columns of the shelf support 100. Thus, articles 200 located in the column on one side of the spacer 10 cannot move towards the adjacent column on the other side of the spacer 10 without intentional manual manipulation by a user. The spacer 10 laterally delimits the two adjacent columns, the two columns being located on each side of the spacer 10.

Articles 200 of a given column are placed between two adjacent spacers 10. Two adjacent spacers 10 fixed on a same shelf support 100 are spaced apart in the lateral direction of the shelf support 100 by a distance corresponding to the column width.

The articles 200 associated with the spacer 10 correspond to the articles 200 located in a column adjacent the spacer 10, for example in the column located to the right of the spacer 10, or in a column located to the left of the spacer 10. The nature and/or position of the articles 200 associated with the spacer 10 relative to the spacer 10 is thus known.

The spacer 10 according to the second example may comprise a partition wall adapted to delimit two adjacent columns of the shelf support 100, the partition wall comprising two opposite side panels 11, 12. The side panels 11, 12 of the spacer 10 may extend substantially in the longitudinal and the vertical direction. Each side panel 11, 12 of the spacer 10 faces each adjacent column delimited by the spacer 10.

A distance between the two opposite side panels 11, 12 of the spacer 10 corresponds to a width of the spacer 10. The width of the spacer 10 may vary in the longitudinal direction. The width of the spacer 10 may be sufficient for the spacer 10 to integrate components of the spacer 10 between the two opposite side panels 11, 12 of the spacer 10.

Components integrated in the spacer 10 include a light emitter 20. Components integrated in the spacer 10 may further include one or several of the following components: a camera 30, a person sensor 50, an identification unit, a communication module, an LCD screen 60, and/or a battery 40.

The spacer 10 may further comprise a front panel 13 adapted to connect the two opposite side panels 11, 12 of the partition wall. The light emitter 20 may be integrated in the front panel 13 of the spacer 10. The front panel 13 may extend substantially in the lateral and the vertical direction, from one side panel 11, 12, to the other side panel 11, 12.

The front panel 13 of the spacer 10 is visible by a person or an imaging device facing the shelf 1 where the spacer 10 is installed, no matter how full the column is. Therefore, as the light emitter 20 is integrated in the front panel 13, between the two opposite sides panels of the spacer 10, the light emitter 20 is visible by a camera 30 facing the shelf 1.

The spacer 10 may further comprise a rear panel located opposite the side panel 11, 12 and adapted to connect the two opposite side panels 11, 12 of the partition wall.

The architecture of the spacer 10, comprising the opposite side panels 11, 12 connected by the front panel 13, forms a stable casing, for fresh and normal environments, the casing being furthermore adapted to integrate components of the spacer 10.

In a first embodiment of the second example, illustrated by way of a non-limiting example in FIG. 3, the spacer 10 forms an integral casing. The two opposite side walls of the spacer 10 may be formed by two opposite plexiglass windows. The width of the spacer 10, that is to say the distance between the two side panels 11, 12, increases next to the front panel 13 of the spacer 10, so as to allow integrating different components of the spacer 10 next to the front panel 13.

In a second embodiment of the second example, illustrated by way of a non-limiting example in FIGS. 5 and 6, the spacer 10 comprises a front casing 15 adapted to integrate components of the spacer 10, and a window 14 adapted to be mounted on the front casing 15, the front casing 15 and the window 14 delimiting together the two adjacent columns. The conception of the spacer 10 is thus modular, which allows to easily remove the window 14 or the front casing 15, for example if a component integrated in the front casing 15 needs to be replaced. The window 14 may be a plexiglass window. The window 14 may be partially inserted in slots provided in the front casing 15 in order to be fixed on the front casing 15. The dimensions of the window 14 may be adapted according to a shelf support 100 size. Such a spacer 10 comprising a front casing 15 and a window 14 removably fixed to each other can thus easily adapt to different shelf support 10 sizes.

The spacer 10 according to the first example or to the second example may further comprise a fixing element 16 adapted to securely fix the spacer 10 to the shelf support 100, as illustrated by way of example in FIGS. 5 and 6.

The light emitter 20 may be a LED.

The light emitter 20 may be configured to emit a visible light, for example a green light. In other words, the light emitter 20 is configured to emit a light with a wavelength comprised in the visible spectrum, that is to say a light with a wavelength comprised substantially between 400 nm and 750 nm, more specifically may be configured to emit a light with a wavelength comprised substantially between 480 nm and 570 nm.

Alternatively, or in addition, the light emitter 20 may be configured to emit an infrared light. In other words, the light emitter 20 is configured to emit a light with a wavelength comprised in an infrared spectrum, that is to say with a wavelength comprised substantially between 750 nm and 1 mm. Thus, the light emitted by the light emitter 20 is not visible by the human eye, that is to say is not visible to the customers of the salespoint, and thus does not risk bothering or disrupting the consumer.

The light emitter 20 may be configured to emit light according to a blinking sequence. The blinking sequence is specific to the spacer 10, so as to allow identification of the spacer 10. The blinking sequence of the light emitters 20 may be configured so that in a given salespoint, or in a given area of the salespoint, each spacer 10 has a light emitter 20 which emits a unique specific blinking sequence, all the blinking sequences emitted by the spacers 10 of the salespoint, or of the given area of the salespoint, being different. Thus, the spacer 10 of a salespoint, or of a given area of the salespoint, can easily and reliably be identified based on the blinking sequence of their light emitter 20.

The light emitter 20 may comprise a wake mode and a sleep mode. In the sleep mode, the light emitter 20 emits no light. In the wake mode, the light emitter 20 emits light in the form of the blinking sequence. The light emitter 20 may be configured to wake at predetermined time intervals, or to be waked on demand by a communication module.

The spacer 10 may comprise a communication module adapted to trigger the blinking sequence of a light emitter 20 according to an order from a base station of the salespoint. The light emitter 20 may be integrated in said spacer 10 and/or in another spacer 10.

The communication module may be integrated in the spacer 10, more particularly in the vicinity of the front panel 13 of the spacer 10, for example in the front casing of a spacer 10 according to the second embodiment of the second example. Alternatively, the communication module may be integrated in a camera 30. Alternatively, the communication module may be integrated in the base station of the salespoint.

The communication module may comprise a near field and/or a far field radio communication module.

More specifically, the communication module may be adapted to communicate with the light emitter 20 of the spacer 10 via near field radio communication, which is very low power consuming. A transmission range of the near field radio communication module may be comprised between 1 meter and 10 meters, for example may be around 5 meters, or around 7 meters. Alternatively, the communication module may be adapted to communicate with the light emitter 20 of the spacer 10 via far field radio communication, which allows command of the light emitters 20 along important distances.

The communication module may be adapted to communicate with the base station via far field radio communication, which allows command of the communication module along important distances, for example a centralized control of all communication modules of the salespoint by the base station of the salespoint. Thus, the base station may simultaneously send orders to all the light emitters 20 of the salespoint to perform instantaneously their blinking sequences. Therefore, an overview of the stocks of all the shelves 1 of the salespoint can be generated at once.

The spacer 10 may further comprise a battery 40 adapted to supply power to the light emitter 20. The battery 40 may be a removable battery, or alternatively may be directly integrated inside the spacer 10 casing, for example between the two opposite side walls of the spacer 10 according to the second example.

The battery 40 may further be adapted to supply power to the camera 30, LCD screen 60, identification unit, communication module, and/or person sensor 50.

The battery 40 may be integrated in a battery pack removably fixed on the spacer 10, for example removably mounted on a side panel 11, 12 of the partition wall of the spacer 10 according to the second example, in the vicinity of the rear panel of the spacer 10.

The battery pack 40 may be of different sizes, according to the power to supply by the battery 40 and the desired autonomy of the battery 40. Thus, the battery 40 may provide a flexible amount of power, adapted to the spacer's 10 needs.

For example, if the spacer 10 comprises a light emitter 20 and a camera 30, the battery 40 may be bigger than if the spacer 10 comprises only a light emitter 20 but no camera 30, so as to supply enough power for all the components of the spacer 10, in particular for the light emitter 20 and the camera 30.

The spacer 10 may comprise a person sensor 50 adapted to detect an object or a person obstructing the light emitter 20 of the spacer 10.

The person sensor 50 may be integrated in the front panel 13 of the spacer 10, next to the light emitter 20. More specifically, the person sensor 50 may be integrated in the front casing of the spacer 10. Therefore, the object or person obstructing a view of the person sensor 50 also obstructs a view of the light emitter 20.

The person sensor 50 is adapted to detect an object or a person blocking a view of the light emitter 20 of the spacer 10, for example an object or person facing the person sensor 50 adjacent the person sensor 50. This may happen when a customer is looking at articles 200 of the support shelf on which the spacer 10 is fixed.

The person sensor 50 may include one or a combination of any of the following sensors: a motion sensor adapted to detect a movement in the field of view of the sensor, a camera adapted to acquire images of the field of view of the sensor, an ambient sensor adapted to detect an amount of light in the vicinity of the sensor, and/or a depth sensor adapted to enrich a camera's information with depth data.

The person sensor 50 may be adapted to continuously detect a person in the field of view of the person sensor 50, or to alternate between a sleep mode in which the person sensor 50 is asleep, and a wake mode in which the person sensor 50 detects a person in the field of view of the person sensor 50.

The communication module may be adapted to trigger a blinking sequence of the light emitter 20 according to an output of the person sensor 50, in addition to the order from the base station. More specifically, the communication module may be adapted to trigger a blinking sequence only if the person sensor 50 detects no object or person obstructing a view of the light emitter 20. The triggering of the blinking sequence is thus delayed until a camera 30 can acquire an unobstructed view of the blinking sequence.

The person sensor 50 allows to improve the efficiency and reduce the energy consumption of the system for stock management. Indeed, if the person sensor 50 detects a person or object susceptible to obstruct a view of the light emitter 20, that is to say susceptible to hinder the acquisition of a blinking sequence by the camera 30, then the communication module may delay the sending of the blinking order to the light emitter 20, in order to wait until the view of the light emitter 20 by the camera 30 is not obstructed anymore. Therefore, the blinking sequence is not performed uselessly when it cannot be acquired by the camera 30 due to the presence of a person or object obstructing the camera's 30 view of the light emitter 20. Similarly, the camera 30 is not woken up to acquire the blinking sequences of the light emitter 20 if there is a risk that the acquisition is useless. Thus, the battery life of the battery 40 supplying power to the light emitter and/or to the camera 30 is prolongated. Finally, the reliability of the spacer 10 identification based on the acquired blinking sequence is increased, as the blinking sequence is performed when no object or person is likely to interfere with the camera's 30 acquisition of the blinking sequence, thus the acquired blinking sequence is whole and undisturbed.

Figure 4:
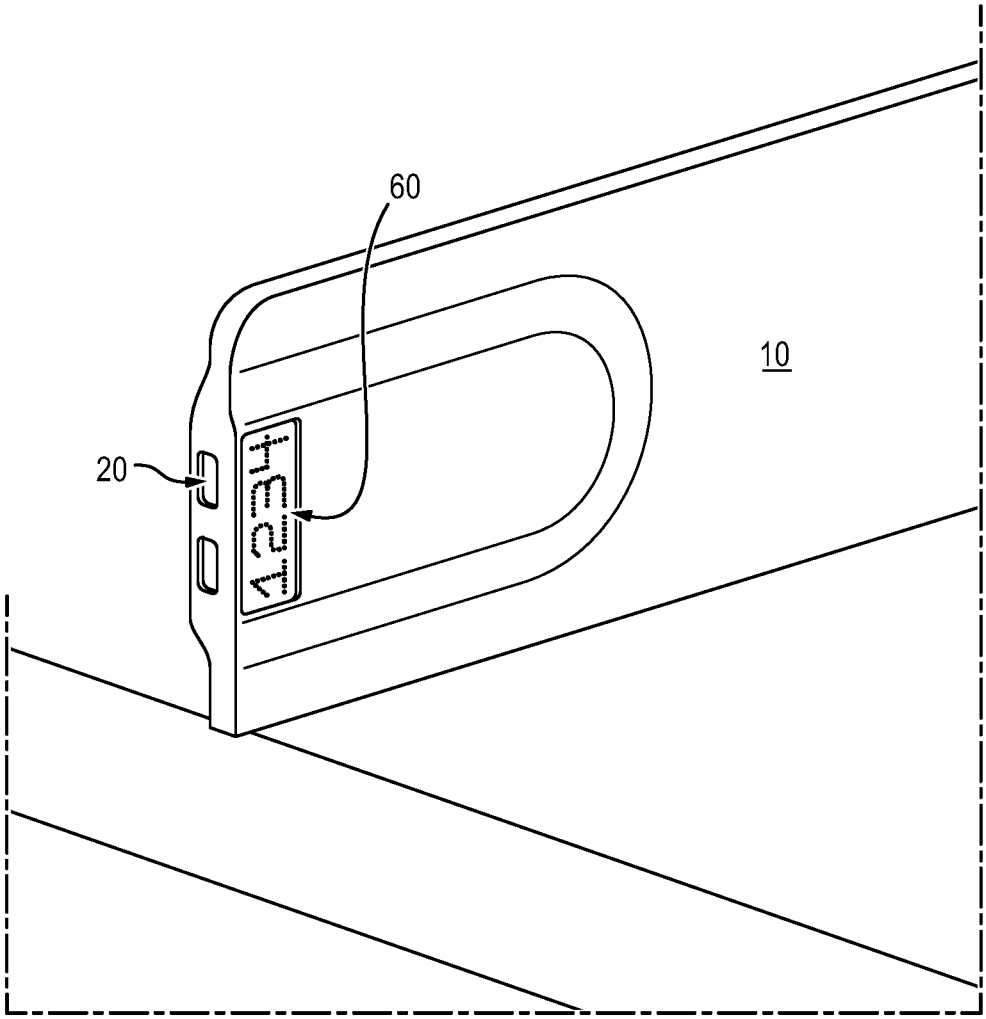
FIG. 4 is an enlarged perspective view of a spacer according to an embodiment of the invention.

The spacer 10 may further comprise an LCD screen 60 integrated in the spacer 10, as illustrated by way of a non-limiting example in FIG. 4. The LCD screen 60 may be integrated in a side panel 11, 12 of the partition wall of a spacer 10 according to the second example, or in the front casing of the spacer 10.

The LCD screen 60 may be adapted to display an identifier, for example a four digits identifier, of an article 200 associated with the spacer 10. Thus, the images acquired by the camera 30 allow identification of both of the spacer 10 and of the article 200 associated with the spacer 10. The risk of mixing up spacers 10 and articles 200 is thus reduced.

As an alternative or in addition, the LCD screen 60 may display an error code and/or a setup code and/or can display the reserve stock in a warehouse of the article 200 associated with the spacer 10. Thus, the LCD screen 60 participates to the efficient stock management by the system.

The LCD screen 60 may be configured to display an article 200 code, for example a 4 digits article 200 code. The LCD offers visual feedback of association.

The spacer 10 may further comprise a camera 30 integrated in the spacer 10, said spacer 10 being a monitoring spacer.

The camera 30 may be adapted to acquire a visible and/or an infrared light, corresponding to a light emitted by the light emitter 20.

The camera 30 may be a 12 MP camera 30.

The camera 30 may comprise a motorized lens allowing to change a viewing direction of the camera 30, that is to say a direction along which the field of view of the camera 30 is substantially orientated. Thus, the field of view of the camera 30 may be adjusted according to the desired application. For example, the lens of the camera 30 may be rotated around one or several rotation axes so as to change the viewing direction. The viewing direction of the camera 30 may be adapted to be manually adjusted by a user and/or may be adapted to be automatically adjusted by an actuator integrated in the camera 30.

For example, the viewing direction of the camera may be substantially oriented along a direction which is perpendicular to a wall, shelf 1 or spacer 10 to which the camera 30 is fixed, and/or may be changed by rotation around one or more axes of rotation.

The camera 30 may comprise a very close field communication module adapted to communicate with a terminal located very close to the camera 30, for example via NFC. A transmission range of the very close field communication module may for example be equal to a few centimeters, more particularly may be comprised between 1 cm and 10 cm. This very short range of communication increases the precision and security of the communication between the camera 30 and the mobile terminal.

The camera 30 may be adapted to acquire images substantially continuously or at discrete time intervals.

The camera 30 may be configured to acquire the blinking sequence of a light emitter 20 integrated in another spacer 10 mounted on a shelf support 100, the light emitter 20 of said other spacer 10 being located in a field of view of the camera 30. The blinking sequence acquired by the camera 30 may consist in a plurality of images including the light emitter 20 of the spacer 10 acquired by the camera 30, the images being taken at a time interval which is sufficiently short so that the parameters of the blinking sequence, such as the number of flashes and the duration of each flash, may be determined based on the acquired images. The camera 30 may also be adapted to acquire images of the LCD screen 60 integrated in the spacer 10.

The camera 30 may further be adapted to acquire images of the shelves 1 and/or shelf supports 100 located in the field of view of the camera 30. The camera 30 may thus detect a near-empty or an empty space on a shelf support 100 in the field of view of the camera 30, which correspond to a stock shortage area.

The camera 30 may thus be positioned so as to acquire images of a spacer 10 and/or a shelf support 100 on which the spacer 10 is mounted. More specifically, the camera 30 may be placed facing the spacer 10 and the shelf support 100 in order to best acquire images of said spacer 10 and/or shelf support 100, on the other side of the aisle relative to the spacer 10 and the shelf support 100. Thus, the camera 30 may efficiently acquire blinking sequences of the light emitter 20 integrated in the spacer 10, and/or may efficiently detect a near-empty or an empty space on the shelf support 100, which correspond to a stock shortage area.

The camera 30 may be positioned and fixed on a wall or a ceiling of the salespoint. Alternatively, the camera 30 may be integrated in the shelf 1, for example may be integrated in the monitoring spacer 10. More specifically, the camera 30 may be integrated in the front panel 13 of the monitoring spacer 10. Thus, as the camera 30 is integrated in the monitoring spacer 10, the positioning and fixing of the camera 30 is precise and reliable, and the camera 30 does not require to be positioned manually by a user.

The camera 30 integrated in the monitoring spacer 10 faces the shelf supports 100 forming the shelf 1 located on the other side of the aisle, thus faces the light emitters 20 integrated in the front panels 13 of the spacers 10 mounted on the opposite shelf supports 100 located on the other side of the aisle. Furthermore, the camera 30 is located at a height which corresponds to a height of a shelf support 100, that is to say substantially directly faces the opposite shelf 1. Therefore, the camera 30 efficiently acquires images of the opposite shelf supports 100, as they are approximately at the same height than that of the camera 30. The acquired image therefore corresponds substantially to what a customer choosing an article 200 to buy sees.

Cameras 30 may be integrated in only some spacers 10 of a shelf 1. Thus, only some spacers 10 of the shelf 1 are monitoring spacers 10, the other spacers 10 of the shelf 1 being regular spacers 10 comprising a light emitter 20 but no camera 30. For example, 1 spacer 10 out of a number ranging between 10 and 50, for example 1 spacer 10 out of 18, may be a monitoring spacer 10 integrating a camera 30. One camera 30 integrated in one monitoring spacer 10 is adapted to acquire the blinking sequences of several light emitter 20 located in several spacers 10. Thus, the costs of the stock management are reduced, while still allowing efficient acquiring images of the blinking sequences and of the shelf supports 100 by the cameras 30 integrated in the monitoring spacers 10.

The spacer 10 may further comprise a button adapted to allow interaction of a user with the spacer 10. For example, an employee may set the spacer 10 into setup mode and/or change an information displayed by the LCD screen 60 by pressing on the button in a predetermined manner, e.g., for a predetermined amount of time or for a predetermined number of times. Thus, the spacer 10 can be checked by the user, for example the user can easily check that the article 200 displayed in the column delimited by the spacer 10 corresponds to the article 200 associated with the spacer 10, and/or verify that the article 200 associated with the spacer 10 is still in stock in the warehouse.

A set of spacers 10 may comprise a plurality of spacers 10 as described above.

Each spacer 10 of the set of spacers 10 may comprise a light emitter 20 having a unique specific blinking sequence different from the blinking sequences of the light emitters 20 of the other spacers 10 of the set of spacers 10, so that for each spacer 10 of the set of spacers 10, the blinking sequence of the light emitter 20 of said spacer 10 allows identification of said spacer 10.

A set of spacers 10 may be installed in a given salespoint, or in a given area of the salespoint, so that one camera 30, for example a camera 30 integrated in a monitoring spacer 10, acquires the blinking sequences of light emitters 20 integrated in spacers 10 of a given set of spacers 10. Thus, the blinking sequences characterize the light emitters 20 with respect to other light emitters 20 in a field of view of a same camera 30.

Several spacers 10 mounted in a same salespoint may have light emitters 20 with identical blinking sequences, as long as the blinking sequences of the light emitters 20 of each spacer 10 of a given set of spacers 10 are different from each other, or as long as the blinking sequences of the light emitters 20 of each spacer 10 visible by a given camera 30 are different.

A system may comprise a spacer 10 as described above and an identification unit. The identification unit may be integrated in the spacer 10, or in the base station.

The identification unit is adapted to receive a blinking sequence emitted by the light emitter 20 of the spacer 10. The camera 30 may be adapted to send the acquired blinking sequence to the identification unit, for example by near field radio communication, the camera 30 then comprising a near field communication module with a transmission range which may be comprised between 1 meter and 10 meters, for example which may be around 5 meters, or around 7 meters.

The identification unit is further adapted to identify the spacer 10 corresponding to the acquired blinking sequence. The identification of the spacer 10 corresponding to the acquired blinking sequence may be performed based on a correspondence table comprising a plurality of blinking sequences. Each blinking sequence is associated to a respective spacer 10 in said correspondence table. The identification unit may comprise a memory adapted to store the correspondence table, and a processor adapted to associate to the acquired blinking sequence the corresponding spacer 10.

A shelf system may comprise a shelf support 100, at least one spacer 10 as described above, the spacer 10 being fixed to the shelf support 100, and a camera 30 as described above, the camera 30 being configured to visually acquire the blinking sequence performed by the light emitter 20 of the spacer 10.

The camera 30 may be integrated in a monitoring spacer 10 as described above, wherein the monitoring spacer 10 is adapted to be fixed to a shelf support 100 so that the light emitter 20 of the spacer 10 is visible by the camera 30 of the monitoring spacer 10. The monitoring spacer 10 and the spacer 10 are thus two different spacers 10, which can be located on opposite sides of an aisle, so that the blinking sequence of the light emitter 20 of the spacer 10 can easily be acquired by the camera 30 of the monitoring spacer 10.

The system may further comprise an identification unit as described above. The identification unit is adapted to receive a blinking sequence acquired by the camera 30. The identification unit is further adapted to identify the spacer 10 corresponding to the acquired blinking sequence. Said identification is performed based on a correspondence table comprising a plurality of blinking sequences, wherein each blinking sequence is associated to a respective spacer 10 in said correspondence table.

A method for spacer 10 identification adapted to be performed by a shelf system as disclosed above, comprises the following steps:

S1: triggering a blinking sequence of the light emitter 20 integrated in the spacer 10 by the communication module;

S2: performing the blinking sequence by the light emitter 20;

S3: visually acquiring the blinking sequence by the camera 30.

This method may be performed by a system according to any of the examples and embodiments disclosed above, and presents substantially the same advantages as the advantages developed above regarding the system. More particularly, this method allows an efficient stock management with no dedicated infrastructure, the spacer 10 being easily installed and cheap, and the positioning of such a spacer 10 and of the articles 200 in the columns delimited by the spacer 10 being precise and reliable.

The method may further comprise a step of visually acquiring, by said camera 30, images of a shelf 1 and/or a shelf support 100 located in the field of view of the camera 30. The camera 30 may thus detect a near-empty or an empty space on a shelf support 100 located in the field of view of the camera 30, which corresponds to a stock shortage area.

This method, comprising acquisition by the camera 30 of a blinking sequence of the light emitter 20 and of images of the shelf support 100, allows identification of the light emitter 20 performing the blinking sequence, more particularly allows identification of the spacer 10 in which the light emitter 20 is integrated.

The camera 30 may be integrated in a monitoring spacer 10. The communication module may trigger the blinking sequence of a light emitter according to an order from the base station of the salespoint.

Figure 7:
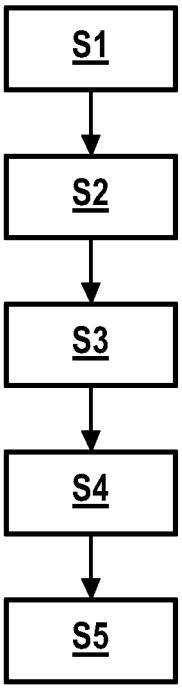
FIG. 7 is a block diagram of a method for spacer identification according to an embodiment of the invention.

As illustrated by way of a non-limiting example in FIG. 7, the method may further comprise the following steps:

S4: receiving, by the identification unit, the blinking sequence acquired by the camera 30; and S5: identifying, by the identification unit, the spacer 10 corresponding to the acquired blinking sequence.

Said identification may be performed based on a correspondence table comprising a plurality of blinking sequences, wherein each blinking sequence is associated to a respective spacer 10 in said correspondence table.

The spacer 10 may be identified in step S5 based on the blinking sequence of the light emitter 20 acquired by the camera 30, and based on the image of the shelf support 100 acquired by the camera 30.

A nature and a position of the articles 200 displayed in the columns delimited by the spacer 10 relative to said spacer 10 is known. The nature of the out-of-stock article 200 can thus be determined by the disclosed method, by identifying the spacer 10 which is associated to, for example which is closest to, the detected stock shortage area. The identification is performed based on the acquired blinking sequence of the light emitter 20, which is specific to said light emitter 20, thus to said spacer 10.

The method may further comprise a step S6 of determining a position and/or a nature of an article 200, based on the identified spacer 10. The position of the article 200 may correspond to a known position of the spacer 10 to which the article 200 is associated in the shelf support 100, in the shelf 1, and/or in the salespoint. For example, the article 200 associated with the spacer 10 may be located in the column delimited by the spacer 10, that is to say on a spacer 10 according to the first example, or adjacent a spacer 10 according to the second example, for example to the left or to the right of the spacer 10. Thus, once the spacer 10 is identified, the corresponding position of the article 200 associated with the spacer 10 can be deduced. The nature of the article 200 may correspond to a known nature of the article 200 associated with the identified spacer 10. For example, the identified spacer 10 may be associated with a specific type of cereals from a specific brand, said cereals being displayed in the column delimited by the spacer 10, or in one or several line(s) of articles 200 included in the column delimited by the spacer 10. Thus, once the spacer 10 is identified, the corresponding nature of the article 200 associated with the spacer 10 can be deduced.

In addition, the camera 30 may also acquire images of the LCD screen 60 integrated in the spacer 10, the LCD screen 60 displaying an identifier, for example a four digits identifier, of the article 200 associated with the spacer 10. Thus, the images acquired by the camera 30 allow redundancy in the identification of the article 200 associated with the spacer 10.

The article 200 whose position and/or nature is determined may correspond to an article 200 presenting a stock shortage risk. The determination of the position and/or nature of the article 200 presenting a stock shortage risk may be performed based on the blinking sequence of the light emitter 20 acquired by the camera 30, and based on the images of the shelf support 100 acquired by the camera 30. The article 200 presenting the stock shortage risk is determined by detecting, in the images acquired by the camera 30, a near-empty or an empty space on the shelf support 100, and by identifying, by the identification unit, the spacer 10 corresponding to the article 200 displayed in the column, or in the line, in which the stock shortage risk is identified. Said spacer 10 identification may be based on the corresponding blinking sequence of the light emitter 20 acquired by the camera 30, said light emitter 20 being located in the spacer 10 delimiting the column where the articles 200 presenting the stock shortage risk are displayed, for example to the right, or alternatively to the left, of the column presenting a stock shortage risk.

The method may further comprise a step of generating an alert if a stock shortage risk is determined. The alert may indicate a position and/or a nature of the article 200 to replenish.

The method may further comprise a step of detecting, by a person sensor, an object or a person obstructing the light emitter 20 of the spacer 10, wherein the communication module is adapted to trigger the blinking sequence of the light emitter 20 in step S1 according to an output of the person sensor. The person sensor 50 may be integrated in the spacer 10 comprising the light emitter 20 intended to perform the blinking sequence.

The invention claimed is:

1. A spacer used to segment products on a shelf support which extends substantially in a shelf support plane and is configured to receive articles placed on the shelf support, the spacer being adapted to extend substantially perpendicularly to the shelf support plane so as to delimit areas of the shelf support where articles are to be placed, wherein the spacer comprises a light-emitter integrated in the spacer and a communication module adapted to trigger the emission of a blinking sequence by the light emitter according to an order from a base station, wherein the blinking sequence is specific to said light emitter and allows identification, by a blinking sequence identification unit configured to decode an acquired blinking sequence using a correspondence table associating each one of a plurality of blinking sequences with a respective spacer, of the spacer in which the light emitter is integrated.

2. The spacer according to claim 1, further comprising:

a partition wall adapted to delimit two adjacent columns of the shelf support, the partition wall comprising two opposite side panels, a front panel adapted to connect the two opposite side panels of the partition wall, wherein the light emitter is integrated in the front panel of the spacer.

3. The spacer according to claim 1, wherein the light emitter is a LED.

4. The spacer according to claim 1, wherein the light emitter is configured to emit a visible light.

5. The spacer according to claim 1, wherein the light emitter is configured to emit an infrared light.

6. The spacer according to claim 1, further comprising a battery adapted to supply power to the light emitter.

7. The spacer according to claim 1, further comprising a person sensor adapted to detect an object or a person obstructing the light emitter, wherein the communication module is adapted to trigger a blinking sequence of the light emitter according to an output of the person sensor.

8. The spacer according to claim 1, further comprising a camera.

9. The spacer according to claim 8, wherein the camera comprises a motorized lens configured to change a viewing direction of the camera.

10. The spacer according to claim 1, further comprising an LCD screen.

11. A set of spacers comprising a plurality of spacers, wherein each spacer is adapted to segment products on a a shelf support which extends substantially in a shelf support plane and is configured to receive articles placed on the shelf support, wherein each spacer is adapted to extend substantially perpendicularly to the shelf support plane so as to delimit areas of the shelf support where articles are to be placed, wherein each spacer comprises a light-emitter integrated in the spacer and a communication module adapted to trigger the emission of a blinking sequence by the light emitter of the spacer according to an order from a base station, wherein the blinking sequence is unique, specific to said light emitter and different from the blinking sequence(s) of the light emitter(s) of the other spacer(s) of the set of spacers, so that, for each spacer of the set of spacers, the blinking sequence of the light emitter of said spacer allows identification, by a blinking sequence identification unit configured to decode an acquired blinking sequence using a correspondence table associating each one of a plurality of blinking sequences with a respective spacer, of the spacer in which the light emitter is integrated.

12. A shelf system comprising:

a set of spacers according to claim 11;

an identification unit, wherein the identification unit is adapted to receive a blinking sequence emitted by the light emitter of a spacer of the set of spacers, wherein the identification unit is further adapted to identify the spacer of the set of spacers corresponding to the acquired blinking sequence based on a correspondence table comprising a plurality of blinking sequences, wherein each blinking sequence is associated to a respective spacer of the set of spacers in said correspondence table; and a shelf support and a camera, wherein a spacer of the set of spacers is fixed to the shelf support, and wherein the camera is configured to visually acquire the blinking sequence specific to the light emitter of the spacer fixed to the shelf support.

13. The shelf system according to claim 12, wherein the camera is integrated in a spacer adapted to segment products on the shelf support and extending substantially perpendicularly to the shelf support plane.

14. A shelf system according to claim 12, wherein the-blinking sequence identification unit is adapted to receive the blinking sequence emitted by the light emitter and acquired by the camera, and is further adapted to identify the spacer corresponding to the acquired blinking sequence based on the correspondence table.

15. A method for spacer identification performed by a shelf system according to claim 14, comprising the following steps:

S1: triggering a blinking sequence of a light emitter integrated in a spacer of the set of spacers by the communication module of the spacer;

S2: performing the blinking sequence by the light emitter of the spacer;

S3: visually acquiring the blinking sequence by the camera;

S4: receiving, by the blinking sequence identification unit, the blinking sequence acquired by the camera; and S5: identifying, by the blinking sequence identification unit, the spacer of the set of spacers corresponding to the acquired blinking sequence, wherein said identification is performed based on a correspondence table comprising a plurality of blinking sequences, wherein each blinking sequence is associated to a respective spacer of the set of spacers in said correspondence table.

* * * * *